US008535611B2

(12) United States Patent
Yamamoto

(10) Patent No.: US 8,535,611 B2
(45) Date of Patent: Sep. 17, 2013

(54) EXHAUST GAS PURIFYING DEVICE

(75) Inventor: Hiroshi Yamamoto, Tochigi (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 299 days.

(21) Appl. No.: 13/058,153

(22) PCT Filed: Jul. 21, 2009

(86) PCT No.: PCT/JP2009/063018

§ 371 (c)(1),
(2), (4) Date: Feb. 8, 2011

(87) PCT Pub. No.: WO2010/016380

PCT Pub. Date: Feb. 11, 2010

(65) Prior Publication Data

US 2011/0142723 A1 Jun. 16, 2011

(30) Foreign Application Priority Data

Aug. 8, 2008 (JP) ..... 2008206129

(51) Int. Cl.
*B01D 50/00* (2006.01)

(52) U.S. Cl.
USPC ..... 422/179

(58) Field of Classification Search
USPC ..... 422/179, 180; 285/367, 368
See application file for complete search history.

(56) References Cited

U.S. PATENT DOCUMENTS

| | | | | |
|---|---|---|---|---|
| 3,991,254 | A | 11/1976 | Takeuchi | |
| 4,378,983 | A * | 4/1983 | Martin | 55/357 |
| 5,250,269 | A | 10/1993 | Langer | |
| 5,697,215 | A | 12/1997 | Canevet et al. | |
| 8,066,792 | B2 * | 11/2011 | Wadke et al. | 55/523 |
| 2003/0159436 | A1 * | 8/2003 | Foster et al. | 60/297 |
| 2006/0277900 | A1 * | 12/2006 | Hovda et al. | 60/299 |
| 2007/0065349 | A1 | 3/2007 | Merry | |
| 2007/0119156 | A1 | 5/2007 | Hill et al. | |

FOREIGN PATENT DOCUMENTS

| | | | |
|---|---|---|---|
| CN | 1771383 | A | 5/2006 |
| EP | 0 758 048 | A1 | 12/1997 |
| JP | 6-33755 | A | 2/1994 |
| JP | 7-30313 | U | 6/1995 |
| JP | 2002-511124 | A | 4/2002 |
| JP | 2003-172121 | A | 6/2003 |
| JP | 2004-263593 | A | 9/2004 |
| JP | 2005-194949 | A | 7/2005 |
| JP | 2005-282535 | A | 10/2005 |

(Continued)

OTHER PUBLICATIONS

Official Letter issued Dec. 6, 2011 in Swedish Patent Application No. 1150173-1, 10 pages.

(Continued)

*Primary Examiner* — Tom Duong
(74) *Attorney, Agent, or Firm* — Fish & Richardson P.C.

(57) ABSTRACT

An exhaust gas purifying device includes: a case body including a plurality of cases, and heat insulating rings and heat insulators that cover the case body over a substantially-entire area from an upstream side to a downstream side in an exhaust gas flowing direction. The heat insulators are placed inward from joint portions between the cases, and the heat insulating rings are placed in such a manner as to bridge over the joint portions between the cases. With the above arrangement, the surface temperature of the case body can be reliably prevented from becoming high.

7 Claims, 7 Drawing Sheets

(56) References Cited

FOREIGN PATENT DOCUMENTS

| | | | |
|---|---|---|---|
| JP | 2005-307828 | A | 11/2005 |
| JP | 2006-524777 | A | 11/2006 |
| JP | 2007-016706 | A | 1/2007 |
| JP | 2007-023996 | A | 2/2007 |
| WO | 98/50688 | A1 | 11/1998 |
| WO | 2004/094794 | A1 | 11/2004 |
| WO | 2004/096794 | A1 | 11/2004 |
| WO | 2010/016381 | A1 | 2/2010 |

OTHER PUBLICATIONS

Office Action issued in corresponding Chinese Patent Application No. 200980130392.0 on Aug. 2, 2012, including English translation, 9 pages.

International Search Report from International Application No. PCT/JP2009/063018, mailed Oct. 27, 2009, 2 pages.

International Search Report from International Application No. PCT/JP2009/063024, mailed Oct. 27, 2009, 1 page.

* cited by examiner

EXHAUST GAS PURIFYING DEVICE

CROSS REFERENCE TO RELATED APPLICATIONS

This application claims priority to Application No. PCT/JP2009/063018 filed on Jul. 21, 2009, which application claims priority to Application No. JP 2008-206129 filed on Aug. 8, 2008. The entire contents of both applications are incorporated herein by reference in their entireties. This application is also related to concurrently filed application Ser. No. 13/058,164, entitled "Exhaust Gas Purifying Device" by Hiroshi Yamamoto that claims priority to Application No. PCT/JP2009/063024 filed Jul. 21, 2009, which application claims priority to Application No. JP 2008-206130 filed on Aug. 8, 2008, having the same assignee as this application, both applications are hereby incorporated by reference in their entireties.

TECHNICAL FIELD

The present invention relates to an exhaust gas purifying device.

BACKGROUND ART

It has typically been known that an exhaust gas purifying device provided is in an exhaust pipe of an engine so that particulate matters (PM), i.e., particulate substances contained in exhaust gas that causes black exhaust, thereby preventing discharge of the PM into the atmosphere. The exhaust gas purifying device is generally provided with a soot filter for capturing PM and an oxidizing catalyst for oxidizing dosing fuel (e.g., diesel oil) to generate heat, the soot filter and the oxidizing catalyst each being covered by a cylindrical case (Patent Literature 1).

CITATION LIST

Patent Literature

Patent Literature 1: JP-A-2004-263593

SUMMARY OF THE INVENTION

Problems to Be Solved by the Invention

According to Patent Literature 1, when the case in which the oxidizing catalyst is provided and the case in which the soot filter is provided are coupled to each other to assemble the exhaust gas purifying device, a space is formed between the oxidizing catalyst and the soot filter.

Inner surfaces of parts of the cases defining this space are directly exposed to exhaust gas having a high temperature, so that the heat of the exhaust gas is transferred from the inner surfaces to outer surfaces of the cases, and, consequently, the surface temperature of the cases becomes high.

An object of the invention is to provide an exhaust gas purifying device capable of preventing surface temperature of a case from becoming high.

Means for Solving the Problems

According to an aspect of the invention, an exhaust gas purifying device includes: a case body that includes a plurality of cases, and a heat insulating unit that covers the is provided to an inner surface of body over a substantially-entire area from an upstream side to a downstream side in an exhaust gas flowing direction; in which the heat insulating unit includes: first heat insulating units and second heat insulating units provided in the plurality of cases, the first heat insulating units being placed in the cases in such a manner as not to protrude from openings of the cases, and the second heat insulating units being placed in such a manner as to bridge over joint portions between the cases.

The term "substantially-entire area" includes an area having a slight gap that happens to be formed in assembling the case body because such a gap does not have a substantial influence on heat insulation ability.

The expression "placed inward" means that the first heat insulating units are housed within the cases in a manner not to protrude from openings of the cases.

With the above arrangement, the heat insulating unit is continuously formed over the substantially-entire area from the upstream side to the downstream side of the case body, thereby reliably preventing the surface temperature of the case body of the exhaust gas purifying device from becoming high.

With the above arrangement, the second heat insulating units are placed in such a manner as to bridge over the joint portions between the cases. Thus, when each of the second heat insulating units is beforehand attached to an end of one of the cases to be coupled, the other case can be guided by the second heat insulating unit so that these cases are fit-coupled to each other, thereby improving assembly efficiency.

In the exhaust gas purifying device, it is preferable that each of the second heat insulting units include: an inner ring member placed on inner sides of the cases; and a heat insulator placed between the inner ring member and inner surfaces of the cases.

With the above arrangement, the inner surface of each of the second heat insulating units is provided with the inner ring member, so that exhaust gas passing through the second heat insulating unit is prevented from easily contacting the heat insulator placed between the inner ring member and the inner surfaces of the cases, thereby preventing deterioration of the heat insulator and improving the durability of the heat insulator.

In the exhaust gas purifying device, it is preferable that each of the second heat insulating units include an outer ring member placed between the inner surfaces of the cases and the heat insulator.

With the above arrangement, the outer ring member is provided between the heat insulator and the inner surfaces of the cases. Thus, when the cases are fit-coupled to each other, the inner surface of one of the cases is in contact with an outer surface of the outer ring member of the other case, thereby favorably preventing the heat insulator from, for instance, getting caught between the cases.

In the exhaust gas purifying device, it is preferable that the inner ring member and the outer ring member be spaced apart from each other.

The expression "being spaced apart from" means being spaced apart in a direction perpendicular to the exhaust gas flowing direction.

With the above arrangement, the inner ring member and the outer ring member are spaced apart from each other. Since the inner ring member and the outer ring member are not in contact with each other, the heat of the inner ring member can be prevented from being transferred to the outer ring member.

In the exhaust gas purifying device, it is preferable that the inner ring member be provided with outer flanges to have a concave cross section.

With the above arrangement, the inner ring member is provided with the outer flanges to have the concave cross section. The outer flanges of the inner ring member serve to prevent the heat insulator from protruding outward. Moreover, exhaust gas passing through the second heat insulating unit is more reliably prevented from easily contacting the heat insulator, thereby more reliably preventing deterioration of the heat insulator and improving the durability of the heat insulator.

According to another aspect of the invention, an exhaust gas purifying device includes: a case body that includes a plurality of cases, and a heat insulating unit that is provided to an inner surface of the case body over a substantially-entire area from an upstream side to a downstream side in an exhaust gas flowing direction, in which the heat insulating unit includes: first heat insulating units and second heat insulating units provided in the plurality of cases, the first heat insulating units being placed in the cases in such a manner as not to protrude from openings of the cases, and the second heat insulating units being placed in such a manner as to bridge over joint portions between the cases, among the plurality of cases, a case placed on an upstream end in the exhaust gas flowing direction is provided with an inflow section into which exhaust gas flows in a radial direction of the case and a case placed on a downstream end in the exhaust gas flowing direction is provided with an outflow section from which the exhaust gas flows in a radial direction of the case, each of the cases provided with the inflow section and the outflow section has a double- wall structure of an inner wall plate and an outer wall plate, and the first heat insulating unit is interposed between the inner wall plate and the outer wall plate.

With the above arrangement, the case body is covered by the heat insulating unit over the substantially-entire area from the upstream side to the downstream side of the exhaust gas flowing direction, and the first heat insulating units are interposed between the inner wall plates and the outer wall plates placed on both end surfaces of the case body. Thus, the case body is entirely covered by the heat insulating unit. Even when exhaust gas having a high temperature passes through the inflow section and the outflow section radially provided to the cases placed on both ends of the case body, the surface temperature of the case body can be reliably prevented from becoming high.

The inflow section and the outflow section are placed in such a manner as to allow exhaust gas to flow into and from the cases in the radial direction, so that an exhaust pipe or the like can be collectively placed, thereby reducing a space for the exhaust pipe.

DESCRIPTION OF EXEMPLARY EMBODIMENTS

Figure 1:
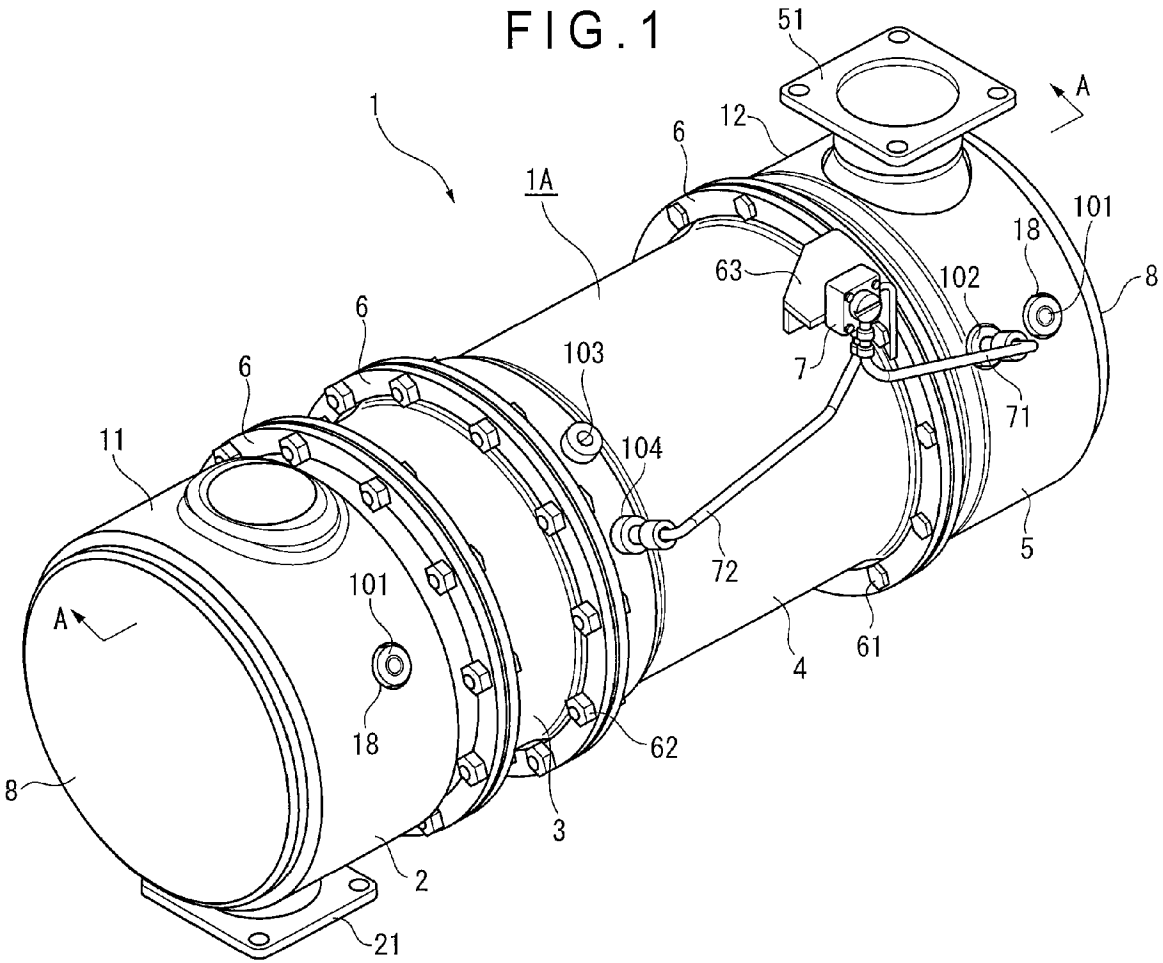
FIG. 1 is a perspective view showing an entire exhaust gas purifying device according to a first exemplary embodiment of the invention.

Exemplary embodiments of the invention will be described below with reference to the attached drawings. In a below-described second exemplary embodiment and subsequent exemplary embodiments, the same reference numerals are attached to components identical to or functionally similar to those in a below-described first exemplary embodiment so as to simplify or omit the explanation thereof.

First Exemplary Embodiment

A first exemplary embodiment of the invention will be described below with reference to the attached drawings.

Hereinafter, an upstream side of an exhaust gas flow direction is referred to as an "upstream side" and a downstream side of the exhaust gas flow direction is a "downstream side" for convenience.

Figure 2:
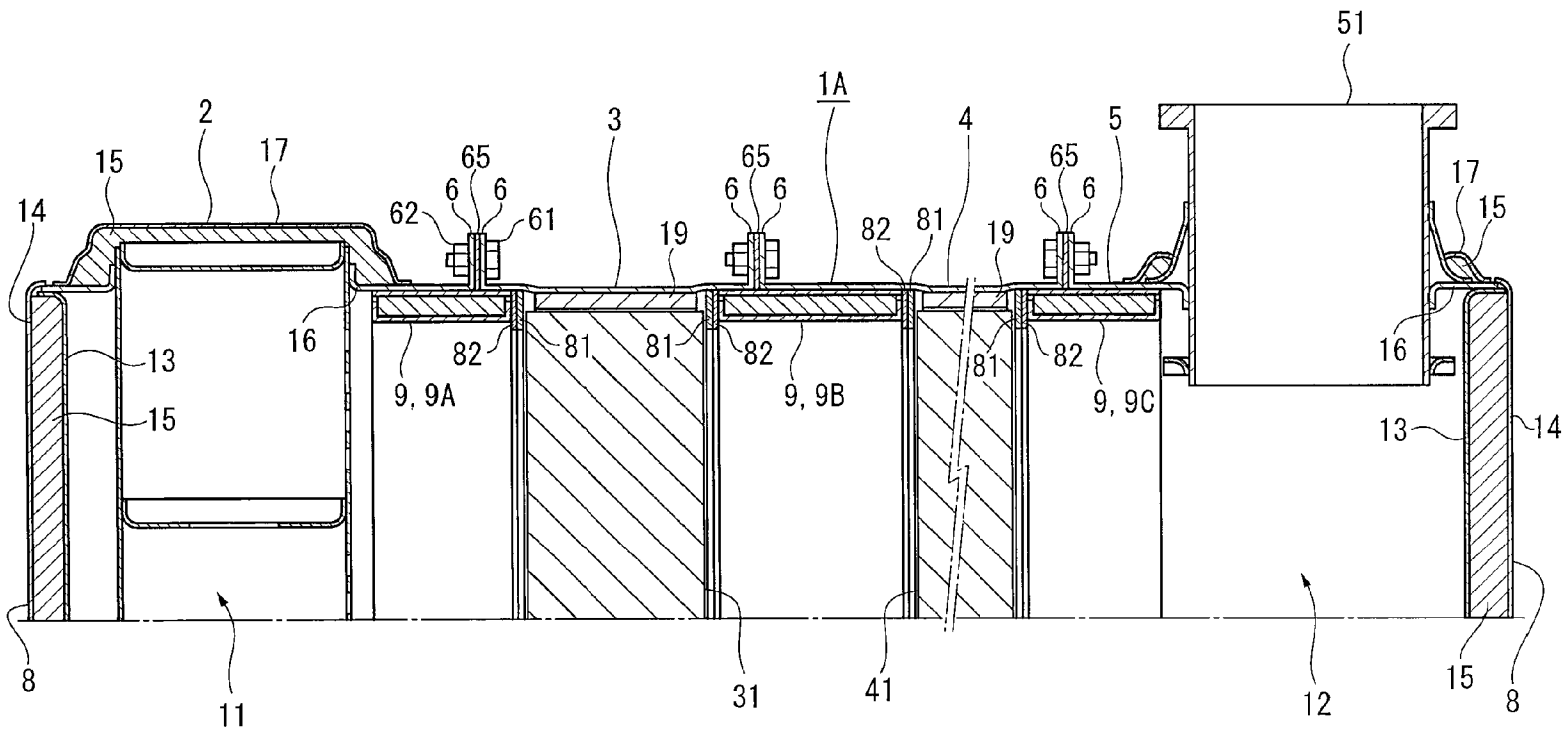
FIG. 2 is an illustration viewed in a direction of arrows A-A in FIG. 1.

FIG. 1 is a perspective view showing an entire exhaust gas purifying device 1 according to this exemplary embodiment. FIG. 2 is an illustration viewed in a direction of arrows A-A in FIG. 1. In FIG. 1, the exhaust gas purifying device 1 is provided between exhaust pipes of a diesel engine (not shown) (hereinafter, simply referred to as an "engine") for capturing PM contained in exhaust gas and is provided with a case body 1A. The case body 1A includes: a cylindrical case 2 connected to the exhaust pipe of the engine; a cylindrical case 3 placed on a downstream side of the case 2; a cylindrical case 4 placed on a downstream side of the case 3; and a case 5 placed on the most downstream side and connected to an outlet pipe (not shown).

The cases 2 and 5 are placed on both ends of the case body 1A and each includes a cylindrical outer periphery provided with a side wall 8. The inner spaces of the cases 2 and 5 respectively function as an inlet chamber 11 and an outlet chamber 12. The case 2 placed on the upstream end is provided with an inflow section 21 into which exhaust gas flows in the radial direction of the case 2. The case 5 placed on the downstream end is provided with an outflow section 51 from which the exhaust gas flows in the radial direction of the case 5. On both end surfaces of the case body 1A, the side wall 8 of each of the cases 2 and 5 has a double-wall structure having an inner wall plate 13 and an outer wall plate 14. A heat insulator 15 made of glass fiber as a first heat insulating unit is interposed between the inner wall plate 13 and the outer wall plate 14. Likewise, the cylindrical portion of each of the cases 2 and 5 has a double-wall structure having an inner cylinder 16 and an outer cylinder 17. The heat insulator 15 is interposed also between the inner cylinder 16 and the outer cylinder 17. With this arrangement, even when exhaust gas passes through the inlet chamber 11 and the outlet chamber 12, heat from the exhaust gas is blocked by the heat insulator 15 to restrain heat transmission to outer surfaces of the cases 2 and 5. A flange joint 6 integrally formed with an exposed portion of the inner cylinder 16 is formed on an opening end of each of the cases 2 and 5.

In the cylindrical case 3, an oxidizing catalyst 31 is placed to oxidize dosing fuel to obtain heat therefrom, and ringed stainless-steel wire meshes 81 and stoppers 82 are provided on both sides of the oxidizing catalyst 31. The stoppers 82 press the oxidizing catalyst 31 via the wire meshes 81 so as to prevent the protrusion of the oxidizing catalyst 31 from the ends of the case 3.

Likewise, in the cylindrical case 4, a soot filter 41 for capturing PM in exhaust gas is housed, and the ringed stainless-steel wire meshes 81 and the stoppers 82 are provided on both sides of the soot filter 41.

The cases 3 and 4 each have a single-wall structure. Heat insulators 19 made of ceramic fiber as the first heat insulating units are interposed between the inner surface of the case 3 and the oxidizing catalyst 31 housed in the case 3, and between an inner surface of the case 4 and the soot filter 41. With this arrangement, heat from exhaust gas passing through the oxidizing catalyst 31 and the soot filter 41 is restrained from being transferred to outer surfaces of the cases 3 and 4. Likewise, in each of the cases 3 and 4, the flange joints 6 are integrally formed on open ends of both sides.

Figure 3:
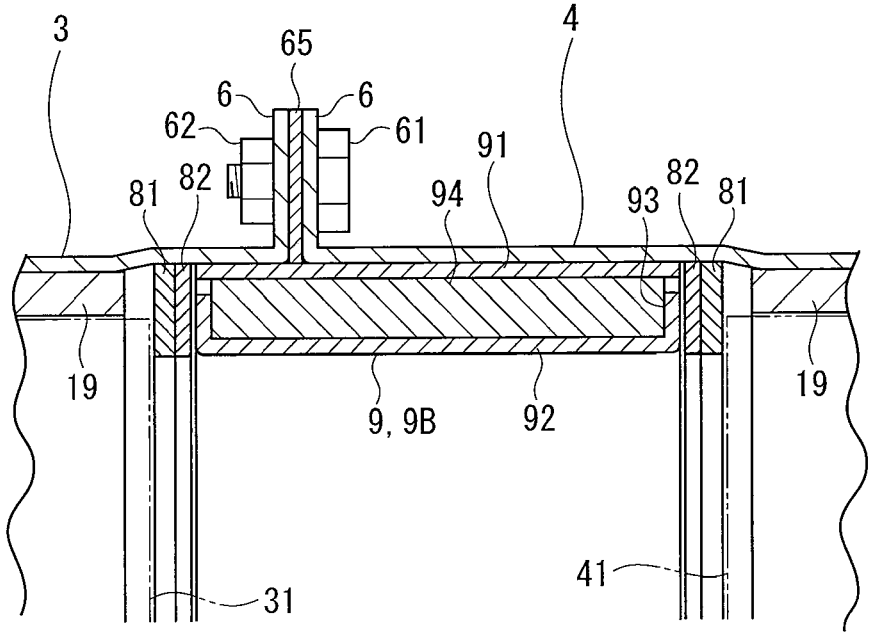
FIG. 3 is a cross sectional view showing a primary part according to the first exemplary embodiment

In the cases 2 to 5 described above, the flange joints 6 facing each other are brought into contact with each other through a sealing material 65 and connected to each other by a bolt 61 penetrating the flanges 6 and a nut 62 screwed onto the bolt 61. The sealing material 65, which is made of exfoliated graphite exhibiting high heat resistance, is placed so as to prevent exhaust gas passing through the exhaust gas purifying device 1 from leaking into to the atmosphere. When the cases 2 to 5 are coupled, heat insulating rings 9 as second heat insulating units are housed so as to respectively bridge interiors of the cases 2 to 5 as shown in FIGS. 2 and 3. Specifically, a heat insulating ring 9A is placed between the cases 2 and 3 in a manner to protrude beyond the flange joint 6 of the case 2 so as to approach an inflow end of the oxidizing catalyst 31. A heat insulating ring 9B is placed between the cases 3 and 4 in a manner to protrude beyond the flange joint 6 of the case 4 so as to approach an outflow end of the oxidizing catalyst 31 and an inflow end of the soot filter 41. A heat insulating ring 9C is placed between the cases 4 and 5 in a manner to protrude beyond the flange joint 6 of the case 5 so as to approach an outflow end of the soot filter 41.

The heat insulating rings 9 (9A, 9B, 9C) each have the same overall structure except for different lengths in the exhaust gas flow direction. Specifically, as shown in an enlarged manner in FIG. 3 (in the figure, the heat insulating ring 9B is shown as a representative example), the heat insulating rings 9 each include: a stainless-steel outer ring member 91 abutting on an inner surface of each of the cases 2 to 5; a stainless-steel inner ring member 92 formed to have a concave cross section and having a pair of outer flanges 93; and a heat insulator 94 made of ceramic fibers and interposed between the outer ring member 91 and the inner ring member 92. The heat insulator 94 is also formed in a cylindrical shape and has an inner diameter substantially equal to an outer diameter of a cylindrical portion of the inner ring member 92.

In each of the heat insulating rings 9, the inner ring member 92 is housed in the outer ring member 91 while the heat insulator 94 having a predetermined thickness is fitted on the outer periphery of the cylindrical portion of the inner ring member 92. As a result, the heat insulator 94 is pressed toward the outer ring member 91 by the inner ring member 92 to be interposed between the respective members 91 and 92 while being compressed. A reaction force at this time prevents positional shift of the inner ring member 92 relative to the outer ring member 91. The heat insulating rings 9 can be assembled in advance for easy handling. Moreover, interposing the heat insulator 94 between the outer flanges 93 prevents the heat insulator 94 from being shifted.

The heat insulating rings 9 are respectively housed in the cases 2 to 5 after the members 91, 92 and 94 are assembled. At this time, the outer ring member 91 is welded to an inner circumference of each of the cases 2 to 5. Welded parts will be described in detail below. In assembled heat insulating rings 9, the inner ring member 92 and the outer ring member 91 are not in contact with each other. Specifically, a thickness of the heat insulator 94 and a height of the outer flanges 93 of the inner ring member 92 are set such that the inner ring member 92 and the outer ring member 91 are not in contact with each other in view of an estimated compressed amount of the heat insulator 94. Accordingly, although the exhaust gas passing the heat insulating rings 9 is directly in contact with the inner ring member 92, heat at this time is restrained from transmitting from the inner ring member 92 to the outer ring member 91 and is favorably blocked by the heat insulator 94.

In each of the heat insulating rings 9, the heat insulating ring 9A radially overlaps with the heat insulator 15 of the case 2 on the upstream side and is adjacent to the heat insulator 19 of the case 3 through the wire mesh 81 and the stopper 82 on the downstream side. The heat insulating ring 9B is adjacent to the heat insulator 19 of the case 3 through the wire mesh 81 and the stopper 82 on the upstream side and is adjacent to the heat insulator 19 of the case 4 through the wire mesh 81 and the stopper 82 on the downstream side. The heat insulating ring 9C is adjacent to the heat insulator 19 of the case 4 through the wire mesh 81 and the stopper 82 on the upstream side and overlaps radially with the heat insulator 15 of the case 5 on the downstream side. Regarding the term "adjacent", the heat insulating rings 9 may be in contact with the heat insulators 19 or may not be in contact with the heat insulators 19.

With this arrangement, the substantially-entire case body 1A of the exhaust gas purifying device 1 from the upstream side to the downstream side is substantially covered by the heat insulators 15, 19 and 94. Even the cases 3 and 4 having no double-wall structure can practically realize a double-wall structure excellent in heat insulating property by using the heat insulating rings 9. Consequently, the outer surfaces of all the cases 2 to 5 are prevented from being easily heated to a high temperature.

The heat insulating ring 9A among the heat insulating rings 9 has a larger engagement margin with the inner cylinder 16 of the case 2 than that with the case 3. The heat insulating ring 9A is housed in the inner cylinder 16 in advance. The heat insulating ring 9B has a larger engagement margin with the case 4 than that with the case 3. The heat insulating ring 9B is housed in the case 4 in advance. The heat insulating ring 9C has a larger engagement margin with the case 5 than that with the case 4. The heat insulating ring 9C is housed in the case 5 in advance. The outer ring members 91 of the heat insulating rings 9 are respectively welded to the cases 2 to 5 at the larger engagement margin between the heat insulating rings 9 and each of the cases 2 to 5. Specifically, the outer ring member 91 of the heat insulating ring 9A is welded to four weld holes (not shown) formed on the outer surface of the case 2. The outer ring member 91 of the heat insulating ring 9B is welded to weld holes of the case 4. The outer ring member 91 of the heat insulating ring 9C is welded to weld holes of the case 5.

Accordingly, in assembling the case body 1A by coupling the cases 2 to 5, a part of the heat insulating ring 9A protrudes from an opening of the case 2. An outer periphery of the protruding heat insulating ring 9A is fitted to an inflow end of the case 3. In other words, an outflow end of the case 2 and the inflow end of the case 3 are fit-coupled to each other while being guided by the heat insulating ring 9A.

Figure 4:
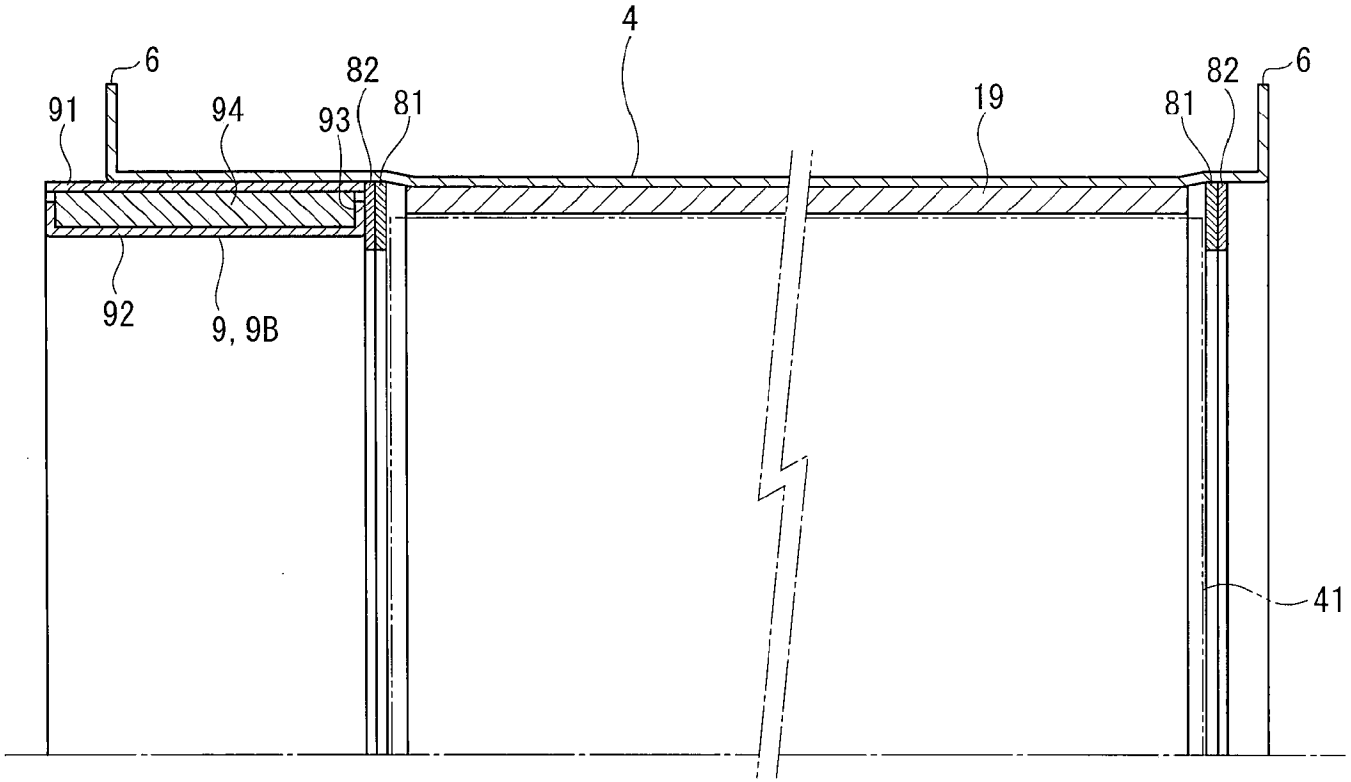
FIG. 4 is a cross sectional view showing a case as a part of the exhaust gas purifying device.

Similarly, as shown in FIG. 4, a part of the heat insulating ring 9B protrudes from an opening of an inflow end of the case 4. An outer periphery of the protruding heat insulating ring 9B is fitted to an outflow end of the case 3, thereby coupling the cases 3 and 4. In other words, the outflow end of the case 3 and the inflow end of the case 4 are also fit-coupled to each other while being guided by the heat insulating ring 9B.

Moreover, a part of the heat insulating ring 9C protrudes from an opening of an inflow end of the case 5. An outer periphery of the protruding heat insulating ring 9C is fitted to an outflow end of the case 4, thereby fit-coupling the cases 5 and 4 to each other.

Specifically, for the above fit-coupling, the heat insulating rings 9A and 9C are set in advance respectively in the cases 2 and 5 (i.e., the both sides of the case body 1A) in such a manner as to protrude from the cases 2 and 5 to face each other. No heat insulating rings 9 is provided in the case 3 housing the oxidizing catalyst 31. In the case 4 housing the soot filter 41, the heat insulating ring 9B is provided in advance only on the upstream side in such a manner as to protrude from the case 4. Accordingly, when the cases 2 to 5 are arranged in a right order, the case 4 in which the soot filter 41 is housed is prevented from being connected at a reverse position (i.e., the inflow end and the outflow end of the soot filter 41 are reversed), so that an orientation of the case 4 for connection can be constantly fixed.

A sensor boss 101 is provided to each of the cases 2 and 5 of the case body 1 for attaching a temperature sensor (not shown) to measure temperature inside the inlet chamber 11 and the outlet chamber 12. The sensor boss 101 is attached to the inner cylinder 16. On the outer cylinder 17, an opening 18 is formed at a position corresponding to the sensor boss 101. A sensor boss 102 is similarly provided to the case 5 at a position adjacent to the sensor boss 101. A rigid pipe 71 such as a steel pipe into which the exhaust gas flows is attached to the sensor boss 102.

Thick disc sensor bosses 103 and 104 are provided on the outer surface near the exhaust gas inflow end of the case 4. The sensor boss 103 is attached with a temperature sensor (not shown) that measures an exhaust gas temperature at the inflow end of the soot filter 41. The sensor boss 104 is attached with a rigid pipe 72 such as a steel pipe into which exhaust gas flows from the inflow end of the soot filter 41. The pipe 72 and the above-described pipe 71 are connected to a differential pressure sensor 7. In this exemplary embodiment, the differential pressure sensor 7 is located close to the exhaust gas outflow end of the case 4 and is attached to the flange joint 6 near the outflow end of the case 4 by the bolt 61 and the nut 62 through a bracket 63.

The differential pressure sensor 7 detects a pressure difference between the inflow end and outflow end of the soot filter 41. In the differential pressure sensor 7, a diaphragm provided with a strain gauge is placed. The diaphragm is displaced by the exhaust gas flowing into the pipes 71 and 72, and the electrical resistance of the strain gauge is changed in response to the displacement of the diaphragm. The differential pressure can thus be detected based on the changed electrical resistance. Within the case 4, the soot filter 41 causes a pressure loss of exhaust gas: a pressure at the inflow end of the soot filter 41 (i.e., a pressure in the soot filter 41 close to the sensor boss 104) is larger than a pressure at the outflow end of the soot filter 41 (i.e., a pressure in the soot filter 41 close to the sensor boss 102). As PM begins to clog in the soot filter 41, the pressure loss, i.e., the differential pressure between the inflow end and the outflow end of the soot filter 41, becomes larger. A clogging degree of the soot filter 41 can be judged based on the differential pressure.

The connected differential sensor 7 and pipes 71 and 72 are placed in such a manner as to bridge over a joint portion between the cases 4 and 5. A dimension of the pipe 72 is larger than that of the pipe 71. Accordingly, in this exemplary embodiment with the different dimensions of the pipes 71 and 72, the orientation of the case 4 for connection, to which the pipe 72 is attached, is fixed relative to the case 5 to which the pipe 71 is attached.

In other words, when the case 4 is coupled to the case 5 in a manner such that the upstream and the downstream are reversed, the sensor bosses 102 and 104 become too close to each other, whereby the rigid pipes 71 and 72 cannot be connected to the sensor bosses 102 and 104 and the differential pressure sensor 7 cannot be attached to the case 4. In view of the above, similarly to the advantage of the above fit-coupling, the case 4 housing the soot filter 41 can be constantly coupled in the fixed orientation and prevented from being attached in a manner such that the upstream and the downstream are reversed.

In an engine room in which an engine is housed, the exhaust gas purifying device 1 of the invention may be attached to a frame and a bonnet constituting an engine room, or may be attached to an upper side of an engine and the like. An attachment position or the like may be appropriately determined at the time of attaching the exhaust gas purifying device 1.

According to this exemplary embodiment, the case body 1A of the exhaust gas purifying device 1 is covered by the heat insulators 15, 19 and 94, so that the surface temperature of the case body 1A is reliably prevented from becoming high due to the exhaust gas passing through the exhaust gas purifying device 1.

Second Exemplary Embodiment

Figure 5:
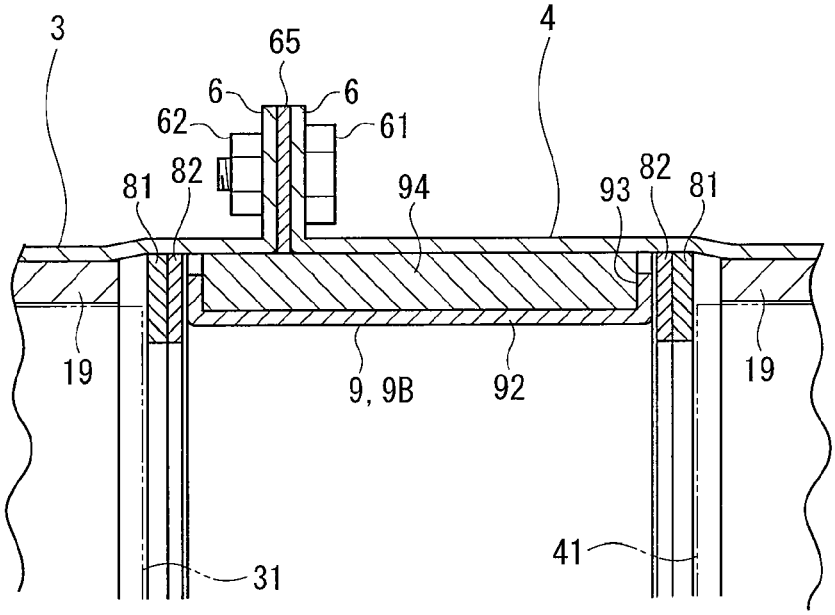
FIG. 5 is a cross sectional view showing a primary part of an exhaust gas purifying device according to a second exemplary embodiment of the invention.

FIG. 5 shows a heat insulating ring 9 according to a second exemplary embodiment. In FIG. 5, the joint portion between the cases 3 and 4 is shown as a representative of example, so that the same heat insulating ring 9 is used for any other joint portion. The same is applied to the below-described third to sixth exemplary embodiments.

The heat insulating ring 9 according to this exemplary embodiment includes the stainless-steel inner ring member 92 having a concave cross section, and the heat insulator 94 made of ceramic fiber set in the inner ring member 92. The outer ring member 91 according to the first exemplary embodiment is not provided to the inner ring member 92.

The heat insulator 94, also having a predetermined thickness, is pressed against the inner surfaces of ones of the cases 2 to 5 by the inner ring member 92 to be compressively housed between the inner surface of the case 4 and the inner ring member 92. Since the inner ring member 92 receives the pressure of the heat insulator 94, the inner ring member 92 can be beforehand attached to the case 4 along with the heat insulator 94 without positional shift relative to the case 4. The inner ring member 92 and the inner surfaces of the ones of the cases 2 to 5 are not in contact in the same manner as in the first exemplary embodiment. Thus, the heat of the inner ring member 92 is prevented from being transferred to the ones of the cases 2 to 5.

In this exemplary embodiment, as well as in the above first exemplary embodiment, the entire exhaust gas purifying device 1 is continuously covered by the heat insulators 15, 19 and 94, thereby reliably preventing the surface temperature of the entire exhaust gas purifying device 1 from becoming high.

Third Exemplary Embodiment

Figure 6:
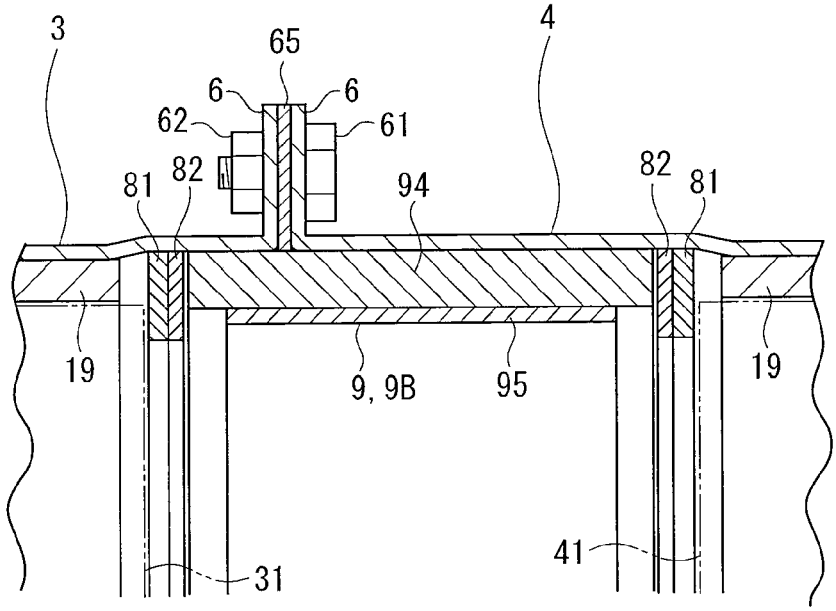
FIG. 6 is a cross sectional view showing a primary part according to a third exemplary embodiment of the invention.

FIG. 6 shows a heat insulating ring 9 according to a third exemplary embodiment.

The heat insulating ring 9 includes a stainless-steel inner ring member 95 and a heat insulator 94 interposed between the inner ring member 95 and the cases 3 and 4. The inner ring member 95 does not have a concave cross section but is formed in a cylindrical shape without the outer flanges 93 (FIG. 3). The other arrangement is the same as in the second exemplary embodiment.

Likewise, in this exemplary embodiment, the surface temperature of the entire exhaust gas purifying device 1 can be reliably prevented from becoming high.

Fourth Exemplary Embodiment

Figure 7:
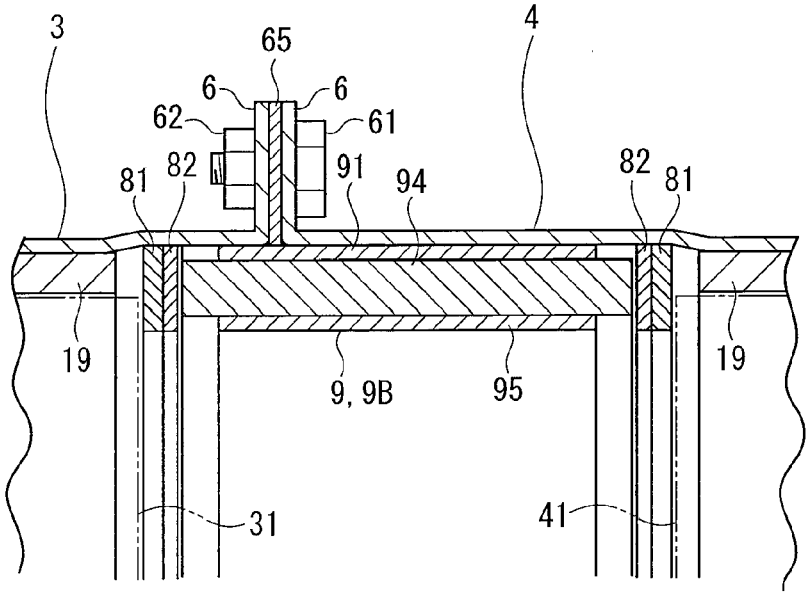
FIG. 7 is a cross sectional view showing a primary part according to a fourth exemplary embodiment of the invention.

FIG. 7 shows a heat insulating ring 9 according to a fourth exemplary embodiment.

The heat insulating ring 9 according to this exemplary embodiment includes the cylindrical outer ring member 91 described in the first exemplary embodiment and the cylindrical inner ring member 95 described in the third exemplary embodiment.

Likewise, in this exemplary embodiment, the surface temperature of the entire exhaust gas purifying device 1 can be reliably prevented from becoming high, so that the same advantages as those of the above first exemplary embodiment can be obtained.

Fifth Exemplary Embodiment

Figure 8:
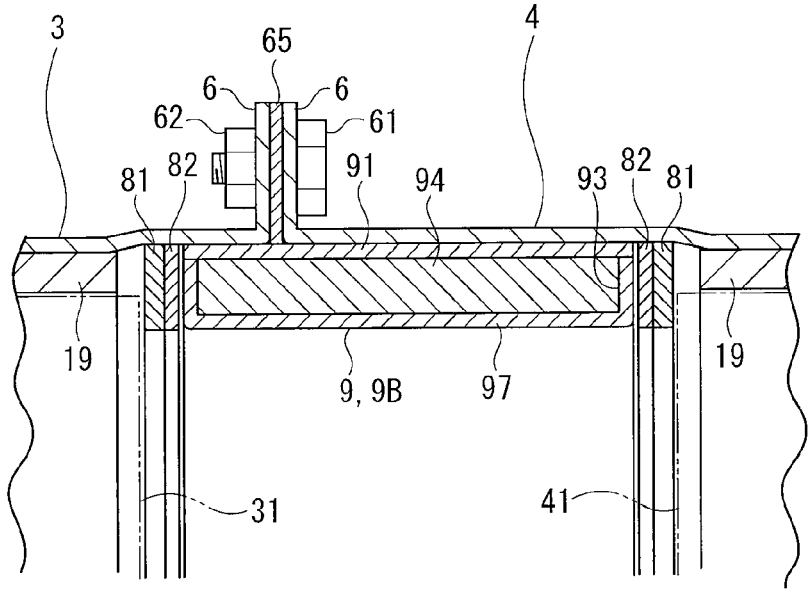
FIG. 8 is a cross sectional view showing a primary part according to a fifth exemplary embodiment of the invention.

FIG. 8 shows a heat insulating ring 9 according to a fifth exemplary embodiment.

Unlike in the first exemplary embodiment, the heat insulating ring 9 according to this exemplary embodiment employs an inner ring member 97 that contacts the outer ring member 91, thereby completely enclosing the heat insulator 94 within a space between the outer ring member 91 and the inner ring member 97.

In this exemplary embodiment, since the heat insulator 94 is completely housed, there is no possibility that the heat insulator 94 is exposed to the exhaust gas. Thus, the deterioration of the heat insulator 94 can be suppressed, thereby improving the durability.

Sixth Exemplary Embodiment

Figure 9:
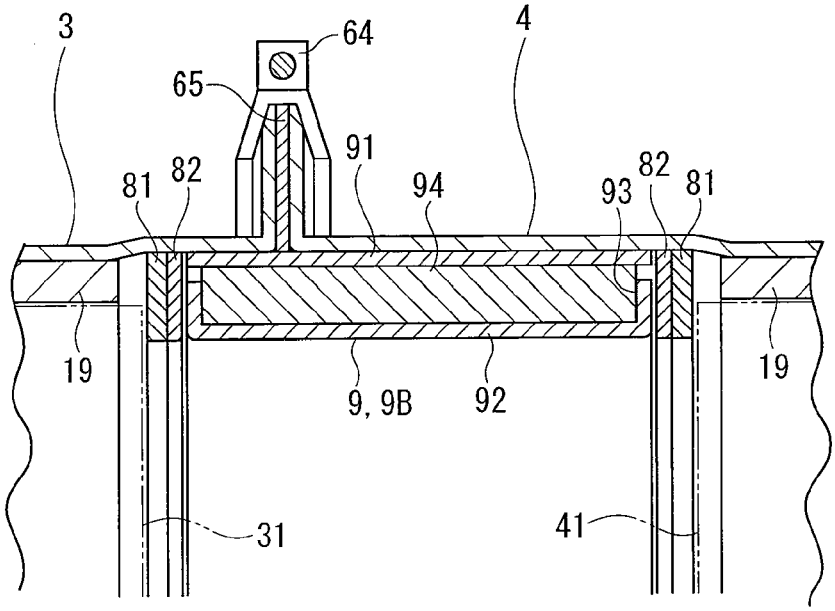
FIG. 9 is a cross sectional view showing a primary part according to a sixth exemplary embodiment of the invention.

FIG. 9 shows a sixth exemplary embodiment.

In the cases 2 to 5 according this exemplary embodiment, the sealing material 65 is interposed between the flange joints 6 and the flange joints 6 are connected by being fastened by a V-shaped clamp 64. With the above arrangement, the cases 2 to 5 can be favorably coupled in the same manner as in the above exemplary embodiments.

Although the best arrangements, methods and the like for carrying out the invention are disclosed above, the invention is not limited thereto. In other words, while the invention has been particularly explained and illustrated mainly in relation to specific embodiments, a person skilled in the art could make various modifications in terms of shape, quantity or other particulars to the above described embodiment without deviating from the technical idea or any object of the invention.

Accordingly, any descriptions of shape or quantity or the like disclosed above are given as examples to enable easy understanding of the invention, and do not limit the invention, so that descriptions using names of components, with any such limitations of shape or quantity or the like removed in part or whole, are included in the invention.

Though the cases 2 and 3 are separately formed in the above exemplary embodiments, the cases 2 and 3 may be integrally formed.

Though the exhaust gas purifying device 1 according to the above exemplary embodiments is provided with the oxidizing catalyst 31, the oxidizing catalyst 31 may be omitted depending on a different regeneration method of the soot filter 41.

Though the heat insulator 94 is made of ceramic fibers in the above respective exemplary embodiments, the heat insulator 94 may be made of glass fibers or any appropriate material.

The invention claimed is:

1. An exhaust gas purifying device comprising:

a case body that includes a plurality of cases, and a heat insulating unit that is provided to an inner surface of the case body over a substantially-entire area from an upstream side to a downstream side in an exhaust gas flowing direction, wherein the heat insulating unit includes first heat insulating units and second heat insulating units provided in the plurality of cases, the first heat insulating units being placed in the cases in such a manner as not to protrude from openings of the cases, and the second heat insulating units being placed in such a manner as to bridge over joint portions between the cases, each of the second heat insulating units includes: an inner ring member placed on inner sides of the cases; a heat insulator placed between the inner ring member and inner surfaces of the cases; and an outer ring member placed between the inner surfaces of the cases and the heat insulator.

2. The exhaust gas purifying device according to claim 1, wherein the inner ring member and the outer ring member are spaced apart from each other.

3. The exhaust gas purifying device according to claim 1, wherein the inner ring member is provided with outer flanges to have a concave cross section.

4. The exhaust gas purifying device according to claim 3, wherein the heat insulator is interposed between the outer flanges of the inner ring member.

5. The exhaust gas purifying device according to claim 1, wherein among the plurality of cases, a case placed on an upstream end in the exhaust gas flowing direction is provided with an inflow section into which exhaust gas flows in a radial direction of the case and a case placed on a downstream end in the exhaust gas flowing direction is provided with an outflow section from which the exhaust gas flows in a radial direction of the case, each of the cases provided with the inflow section and the outflow section has a double-wall structure of an inner wall plate and an outer wall plate, and the first heat insulating unit is interposed between the inner wall plate and the outer wall plate.

6. The exhaust gas purifying device according to claim 1, wherein the heat insulator is pressed by the inner ring member toward the outer ring member.

7. The exhaust gas purifying device according to claim 1, wherein the outer ring member abuts the inner surfaces of the cases.

* * * * *